US005865340A

United States Patent [19]

Alvern

[11] Patent Number: 5,865,340

[45] Date of Patent: Feb. 2, 1999

[54] FLUID FILLER GUN DISPLAY DEVICE INCLUDING A COUPON DISPENSER

[75] Inventor: Stein Alvern, Houston, Tex.

[73] Assignee: Alvern-Norway A/S, Norway

[21] Appl. No.: 805,316

[22] Filed: Feb. 25, 1997

[51] Int. Cl.[6] ..... B65H 16/00

[52] U.S. Cl. ..... 221/13; 221/15; 221/71; 221/133; 221/155; 221/199; 221/96; 221/258; 141/98; 222/192

[58] Field of Search ..... 141/98, 392; 222/192, 222/566; 221/13, 15, 71, 133, 155, 199, 255, 258, 96

[56] References Cited

U.S. PATENT DOCUMENTS

| | | | |
|---|---|---|---|
| D. 173,006 | 9/1954 | Anderson . | |
| D. 173,007 | 9/1954 | Anderson . | |
| D. 279,483 | 7/1985 | Goldman . | |
| D. 279,484 | 7/1985 | Goldman . | |
| D. 366,310 | 1/1996 | Fell . | |
| 4,408,791 | 10/1983 | Griffin et al. . | |
| 4,465,209 | 8/1984 | Wilder . | |
| 4,690,182 | 9/1987 | Knaus . | |
| 5,058,637 | 10/1991 | Fell . | |
| 5,184,309 | 2/1993 | Simpson et al. . | |
| 5,184,655 | 2/1993 | Fell . | |
| 5,249,705 | 10/1993 | Gates | 221/71 |
| 5,458,170 | 10/1995 | Ferguson | 141/392 |

FOREIGN PATENT DOCUMENTS

| | | |
|---|---|---|
| AU-S-122642 | 2/1995 | Australia . |
| AU-S-123343 | 5/1995 | Australia . |
| 0407271A1 | 1/1991 | European Pat. Off. . |
| 62-208396 | 9/1987 | Japan . |
| 850627 | 10/1992 | Japan . |
| 1393062 | 5/1975 | United Kingdom . |
| 2147273 | 5/1985 | United Kingdom . |
| WO 90/08375 | 7/1990 | WIPO . |

*Primary Examiner*—H. Grant Skaggs
*Attorney, Agent, or Firm*—Finnegan, Henderson, Farabow, Garrett and Dunner, L.L.P.

[57] ABSTRACT

A display device for a fluid filler gun head includes a carrying body and a frame attached to an upper surface of the carrying body, defining a display portion for removable display placards. The carrying body can be removable from the gun head or can be an integral part of the gun head itself. A housing is defined in the carrying body for holding one or more replaceable rolls of coupons, and a rotating device, is provided for rotating the coupon rolls and dispensing one or more coupons through a slot in the carrying body. A controller can be provided to control operation of the rotating device, based on information received from an external source, to dispense one or more selected coupons. The information can be a type of fluid being dispensed, a particular product displayed on the display placard, or the like. The dispensed coupons preferably are selected to match the information received by the controller. Alternatively, the coupon dispensers can be attached directly to a display card, removably attachable to a standard filler gun display device.

29 Claims, 8 Drawing Sheets

FLUID FILLER GUN DISPLAY DEVICE INCLUDING A COUPON DISPENSER

BACKGROUND OF THE INVENTION

1. Field of the Invention

The present invention relates to a display device for a fluid filler gun. More particularly, the present invention relates to a display device for a filler gun head that includes a coupon dispenser.

2. Description of the Related Art

Filler gun display devices are known. A saddle or carrying body, usually made of pliable or rigid synthetic material, slides in place over a gun head of a fluid filler gun used with a fluid pump, e.g., a gasoline pump, oil pump, water pump, or the like, provided at an automobile service station. The carrying body typically includes a display surface where replaceable display placards can be mounted. The display placards can be used to label the type of gasoline or other fluid dispensed by the particular gun head. The display placard also can be used to advertise products or services for sale at the service station or another location, or for any other desired advertising purpose. The carrying body can be removable from the gun head, or may be an integral part of the gun head itself.

Unfortunately, the display placard itself does not always provide sufficient inducement to the consumer to purchase the products or services being advertised on the display device. It would be commercially advantageous to provide the consumer with an additional inducement, such as one or more discount coupons, to encourage the consumer to purchase goods and services. It could be particularly advantageous if such coupons could be tied to the particular product being advertised on the display device, or to the particular fluid being dispensed by the filler gun, and if the coupons could be provided to the consumer simultaneously with the consumer's use of the filler gun.

SUMMARY OF THE INVENTION

The present invention is provided to overcome one or more deficiencies in the conventional apparatus described above.

In accordance with the invention, a display device attaches to a fluid filler gun, the filler gun including a barrel, a gun head and a handle. The display device includes a carrying body removably attached to the gun head, the carrying body including right and left side portions and an upper portion having an upper surface. A frame attaches to the upper portion of the carrying body, the frame and upper surface defining a display portion for holding a removable display placard. A coupon dispensing housing is defined in the carrying body for holding a replaceable roll of coupons. A rotating means is provided in the carrying body for rotating the roll of coupons and feeding the coupons through a coupon dispensing slot defined in one of the side portions or the upper portion of the carrying body.

The rotating means feeds out coupons in response to operation of the filler gun.

The coupon dispenser housing further can house a plurality of rolls of coupons, and the rotating means can feed out one or more selected coupons in response to operation of the filler gun.

The display device further can include a controller for receiving information, e.g., the type of fluid dispensed by the filler gun, a product displayed on the display placard, or individual consumer-targeted information from a database keyed by the consumer's credit card. The controller instructs the rotating means to feed out one or more selected coupons in response to the received information.

It is further in accordance with the invention to provide a fluid filler gun, including a barrel, a gun head, and a handle. The carrying body is included as an integral part of the upper portion of the gun head and defines an upper surface. A frame attaches to the upper surface of the gun head to define a display portion for holding a removable placard. A coupon dispenser housing is defined in the gun head for holding a replaceable roll of coupons. A rotating means in the gun head rotates the roll of coupons and feeds the coupons through a coupon dispensing slot defined in one of the side walls or the upper surface of the gun head.

It is also in accordance with the inventor to provide a display attachable to a display device of a fluid filler gun. The display comprises a card defining a support surface configured to removably insert into the filler gun display device. A housing is mounted on the support surface, the housing being configured to enclose a removable plurality of coupons. A feeding means is provided for feeding the coupons sequentially through an opening in the housing.

Additional objects and advantages will be set forth in the description which follows, and in part will be understood from the description, or may be learned by practice of the invention. The objects and advantages may be obtained by means of the combinations set forth in the attached claims.

BRIEF DESCRIPTION OF THE DRAWINGS

The accompanying drawings, which are incorporated in and comprise part of the specification, illustrate preferred embodiments of the invention. Together with the general description given above and the detailed description given below, the drawings serve to explain the principles of the invention. In the drawings.

DETAILED DESCRIPTION OF THE PREFERRED EMBODIMENTS

Reference will now be made in detail to the present preferred embodiments of the invention as illustrated in the accompanying drawings.

Figure 1:
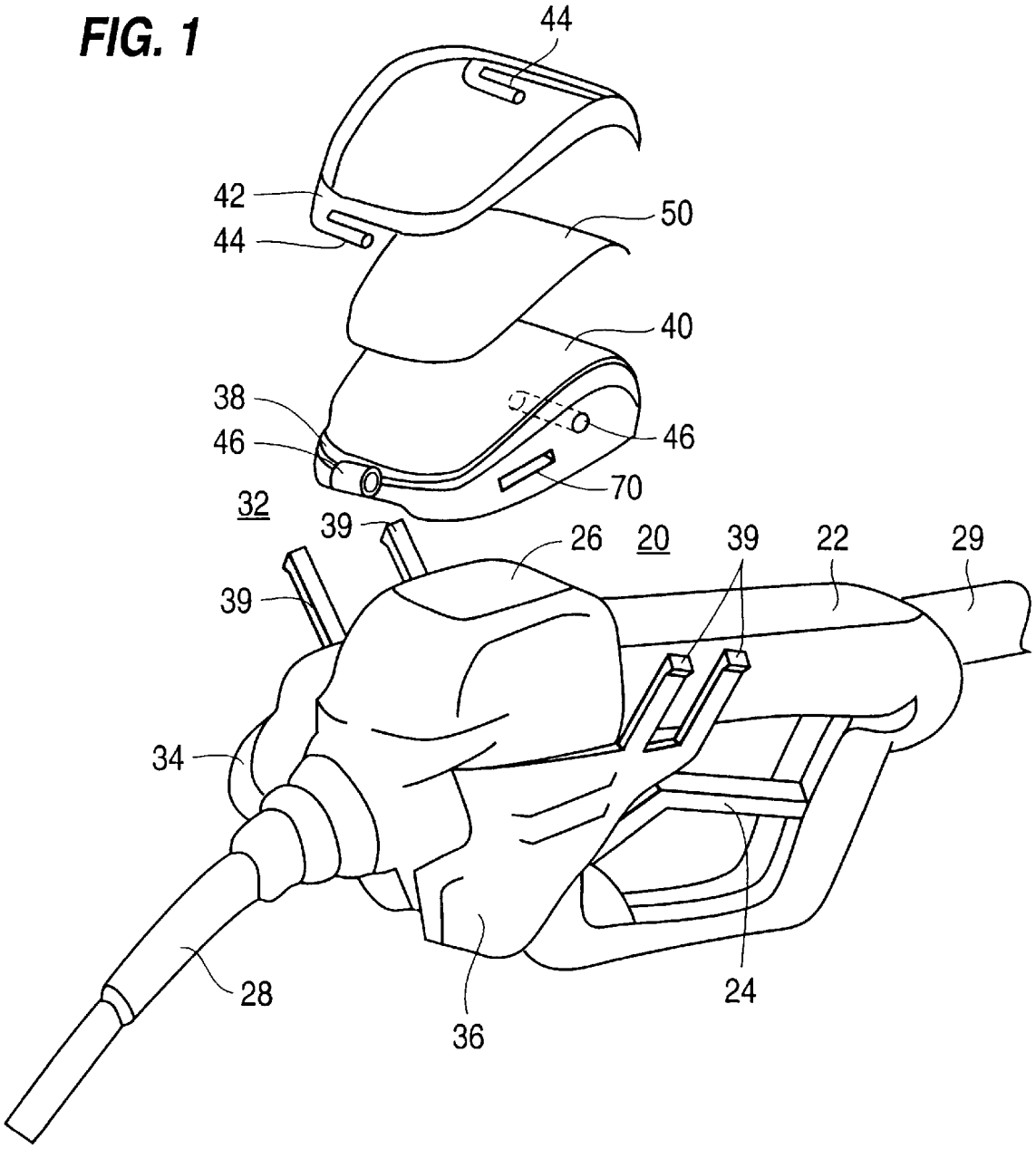
FIG. 1 is a perspective exploded part view of one embodiment of the invention.

A display device is attachable to a fluid filler gun. Referring to FIG. 1, a fluid filler gun 20 includes in sequence a handle 22, a gun head 26, and a barrel 28. A trigger 24 in handle 22 opens and closes a valve (not shown) in gun head 26 to pass fluid from a hose 29 to barrel 28. The filler gun 20 may have a number of shapes and configurations, and is typically used in automobile service stations. Filler gun 20 accordingly may be a gasoline pump filler gun, oil pump filler gun, or the like.

A display device includes the following components. A carrying body removably attaches to the gun head, the carrying body including side portions and an upper portion having an upper surface. As shown in FIG. 1, carrying body 32 includes side portions 34 and 36, and an upper portion 38. The side portions 34, 36 and upper portion 38 detachably snap together via interlocking snap tabs 39 projecting from side portions 34, 36 and engaging with apertures (not shown) in upper portion 38, or through the use of similar interlocking devices.

Figure 2:
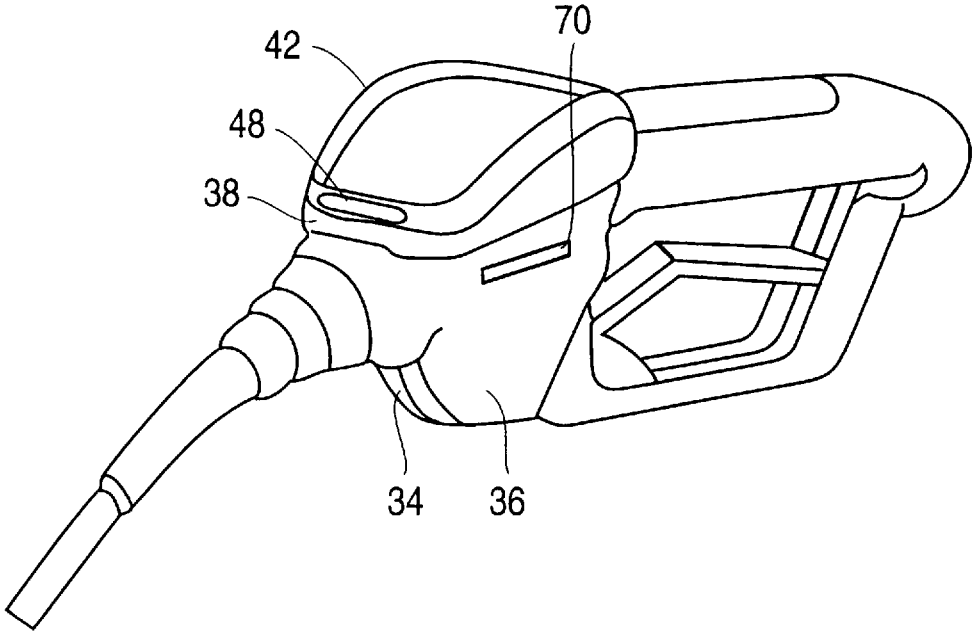
FIG. 2 is a perspective view of a second embodiment of the invention.
Figure 4:
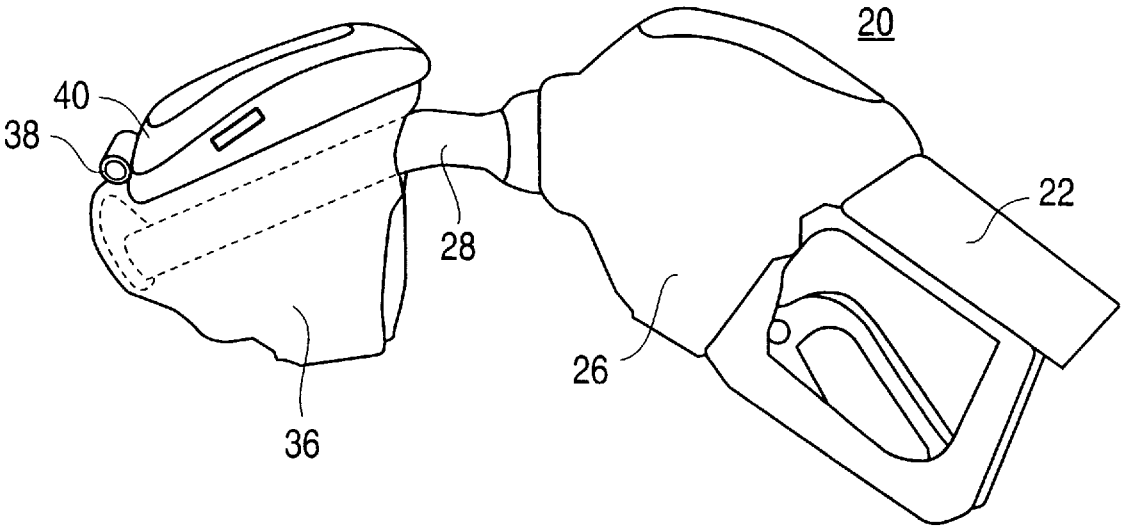
FIG. 4 is a perspective view of a fourth embodiment of the invention, partly disassembled.

Side portions 34, 36 can be provided as two separate connectable pieces, that snap together to surround the bottom and sides of the gun head 20, as shown for example in FIGS. 1 and 2. Alternatively, as shown in FIG. 4, the side portions 34, 36 and upper portion 38 can be formed as a molded unitary piece, defining a sleeve open at both ends. In the configuration shown in FIGS. 4 and 5, the unitary piece side portions 34, 36 can slide in place over gun head 20, with barrel 28 projecting out one open end, and handle 22 projecting out the other open end.

Other configurations for carrying body 32 are also possible. For example, side portions 34, 36 can be open at the bottom, and joined together by straps passing beneath the underside of the filler gun head. The invention is not limited to any particular configuration of carrying body 32.

Persons skilled in the art will recognize that gun head 20 often is covered with a flexible rubber or plastic boot. These flexible boots are provided with gasoline filler guns to prevent the gun head, upon insertion into an automobile gas tank, from scratching the automobiles paint. Carrying body 32 is made of a rigid material, preferably a rigid plastic, and is dimensioned such that it can attach or slide over gun head 20 with the flexible boot either in place or removed.

The upper portion 38 of the carrying body 32 includes an upper surface 40. Preferably, upper surface 40 is arcuate from front to rear, but this shape is not required. Upper surface 40 can be planar or angled as well.

In accordance with the invention, a frame attaches to the upper portion of the carrying body, the frame and the upper surface of the carrying body defining a display portion for holding a removable display placard. As shown in FIG. 1, a frame 42 is provided, which attaches to upper portion 38 of carrying body 32. In FIG. 1, frame 42 removably attaches to upper portion 38 by insertion of male members 44 into female receptacles 46 provided at the front and rear end of upper portion 38.

In another embodiment, shown in FIG. 2, frame 42 is formed integrally with upper portion 38, and does not move or remove therefrom. In the embodiment of FIG. 2, a slot 48 is provided in frame 42 for purposes explained below.

Figure 3:
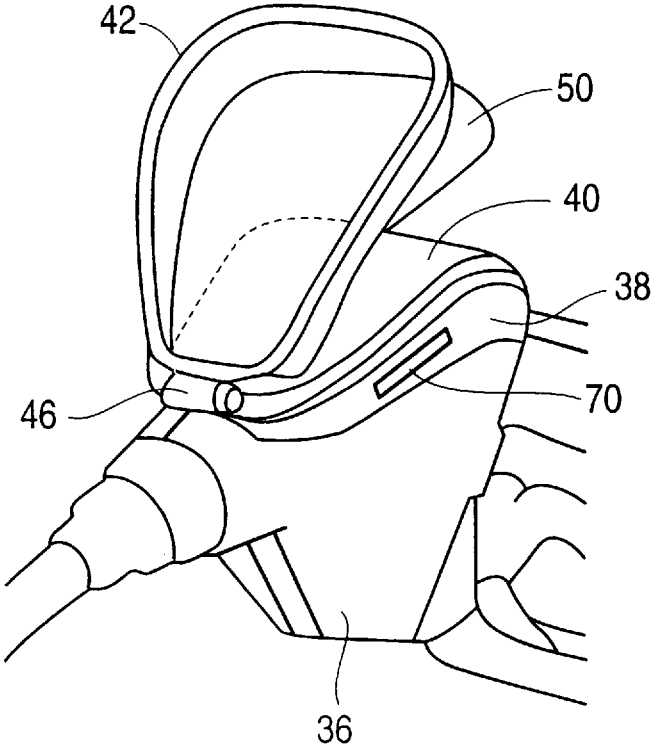
FIG. 3 is a perspective view of a third embodiment of the invention.

In another embodiment, shown in FIG. 3, frame 42 is pivotally attached to upper portion 38. In the embodiment of FIG. 3, a hinge is formed by insertion of a male member 44 into a female receptacle 46 on either the front or rear of upper portion 38.

Frame 42 defmes a central opening. The central opening can either be empty, or have a transparent cover, either plastic or glass, inserted in the opening.

As described above, frame 42 and upper surface 40 define a display portion. A removable placard 50 is inserted between frame 42 and upper surface 40. The display placard 50 can be any one of a plurality of displays. For example, display placard 50 can be used to label the type of fluid being dispensed by the filler gun, e.g., leaded or unleaded gasoline, a particular gasoline octane, oil, water, or the like. Alternatively, display placard 50 can be used to advertise a variety of products or services, either available at the service station or available at some other location.

In the embodiment of FIG. 1, frame 42 is removed from upper portion 38 and reattached to upper portion 38 each time placard 50 is replaced. In the embodiment of FIG. 3, frame 42 is pivoted away from upper portion 38 to replace placard 50. In the embodiment of FIG. 2, placard 50 is replaced by removal and insertion of placard 50 through slot 48.

In the embodiments of FIGS. 1 and 3, where frame 42 either removes or pivots away from upper portion 38, a suitable locking device (not shown) can be provided to hold the frame closed, preventing inadvertent removal or theft of display placard 50.

Figure 6:
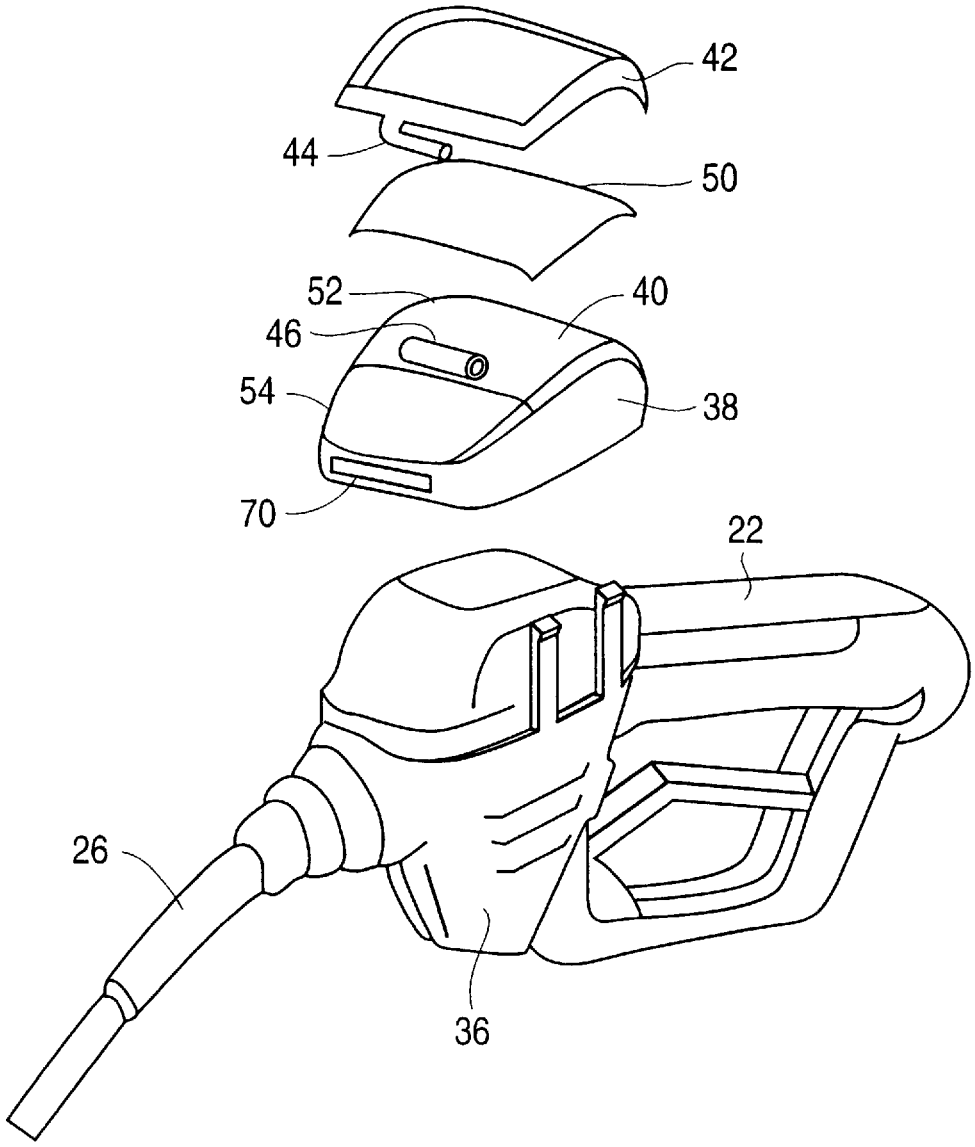
FIG. 6 is a perspective exploded part view of a fifth embodiment of the invention.
Figure 7:
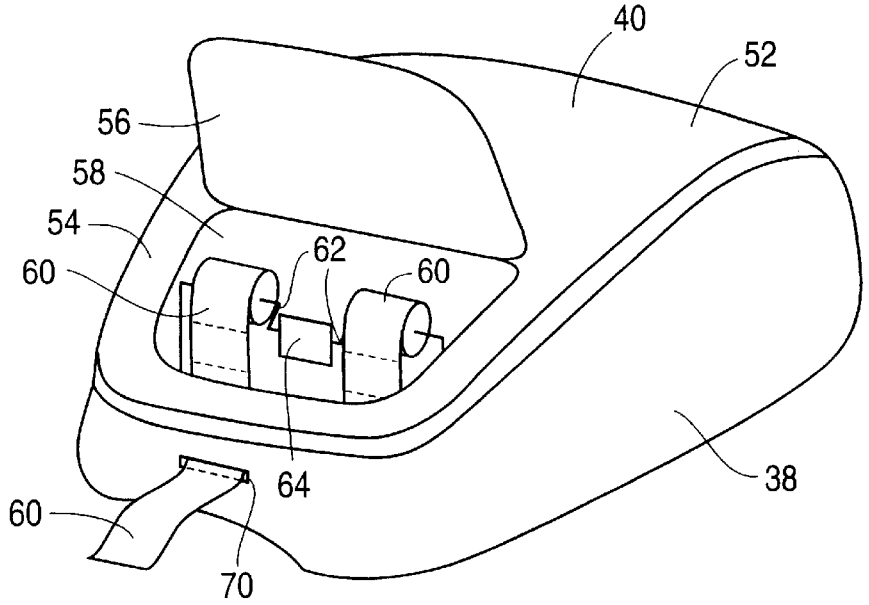
FIG. 7 is a perspective view of an upper portion of the embodiment of FIG. 6, depicting the coupon dispenser assembly in accordance with the invention.

The embodiments of FIGS. 1–3 depict the display surface 40 comprising the entire upper surface of upper portion 38, and frame 42 disposed over the entire upper surface of upper portion 38. It is also possible, as shown in FIGS. 6 and 7, for display surface 40 and frame 42 to comprise and be disposed over only a first portion 52 of the upper surface of upper portion 38. A second portion 54 of the upper surface is not part of the display portion, and instead functions for purposes described below.

In accordance with the invention, a coupon dispenser housing is defined in the carrying body for holding a replaceable roll of coupons. As shown in FIG. 7, the second portion 54 of upper portion 38 of carrying body 32 includes a pivotable door 56 covering a trough or housing 58. The housing 58 is large enough to hold at least one replaceable roll of coupons 60 on a spindle 62. Spindle 62 is rotatable, and includes a keyed or splined shaft capable of locking the coupon roll 60, so that coupon roll 60 will rotate with spindle 62. It is preferred, however, that housing 58 be large enough to hold two or more replaceable rolls of coupons 60 on separate spindles 62.

Figure 8:
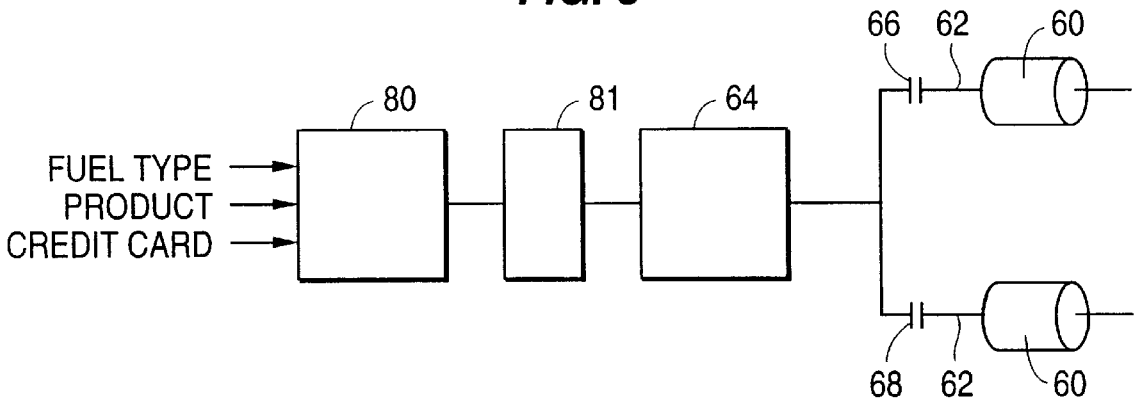
FIG. 8 is a schematic depiction of the control system of the coupon dispenser assembly in accordance with the invention.

In accordance with the invention, a rotating means is provided in the carrying body for rotating the roll of coupons and feeding the coupons through a coupon dispensing slot defined in one of the side portions or the upper portion of the carrying body. As shown in FIGS. 7 and 8, rotating device 64 is provided in housing 58, capable of rotating spindle 62 to thereby rotate coupon roll 60. Rotating device 64 can be a DC motor powered by a battery (not shown). Alternatively, rotating device 64 can be a pneumatic motor, powered by flow of fluid through the filler gun. A pneumatic motor is preferable to an electric motor when the filler gun is used to pump gasoline or other explosive or flammable fluids. Alternatively, rotating device 64 can be a spring-loaded ratchet mechanism. The spring-loaded device can be operated automatically (as described below), or operated by manually pressing a button or turning a small stem projecting from housing 58, that can rotate spindle 62 a preselected amount in order to feed a preselected number of coupons (preferably a single couple per customer). When two or more coupon rolls 60 are provided as shown in FIG. 7, rotating device 64 is linked to only one spindle 62 and coupon roll 60 at a time, by selective closing of contacts 66 or 68, as shown schematically in FIG. 8.

Figure 5:
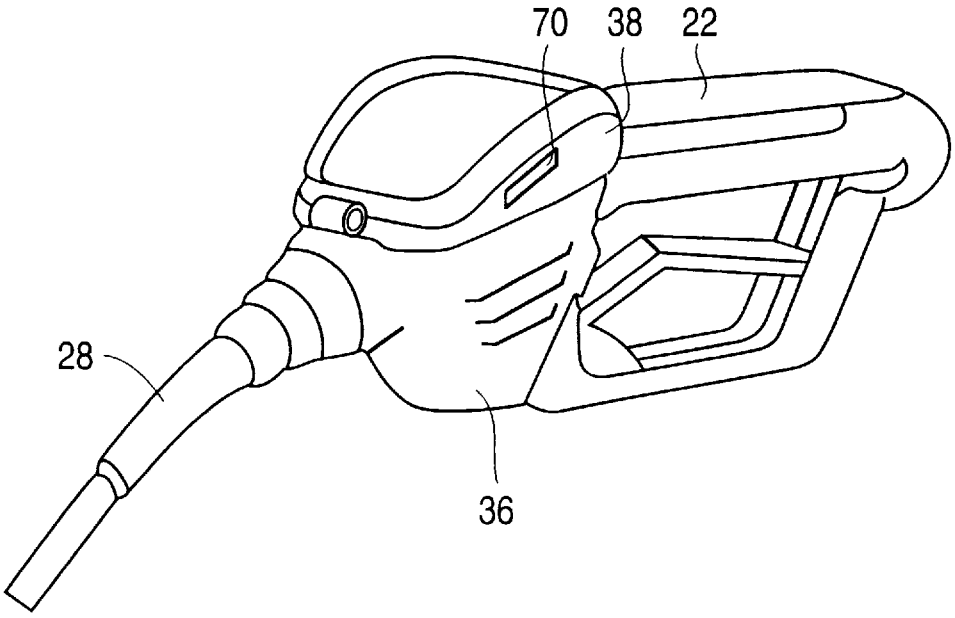
FIG. 5 is a perspective view of the embodiment of FIG. 4 with the parts assembled.

Individual coupons 60 are fed through a slot 70 provided in carrying body 32. The slot 70 can be provided in a variety of locations. In the embodiments of FIGS. 1, 3, and 5, slot 70 is provided on a side of upper portion 38. In the embodiments of FIGS. 6 and 7, slot 70 is provided on the front of upper portion 38. It is also possible, as shown, e.g., in the embodiment of FIG. 2, to provide the slot 70 in side portion 36. The location of the slot 70 is not critical. Likewise, the precise location of housing 58 and door 56, and the orientations of coupon rolls 60 within housing 58, also are not critical, as long as coupon rolls 60 can be stored in and fed out of some portion of carrying body 32.

Preferably, a controller is included with the display device, electrically connected to the rotating device to control operation of the rotating device in response to operation of the filler gun. As shown in FIG. 8, controller 80 is capable of energizing and deenergizing rotating device 64 in order to, for example, cause coupon roll 60 to rotate sufficiently to feed one or more coupons at a time through slot 70.

It is further preferred that controller 80 be configured to receive one or more information signals, e.g., from the fluid pump to which it is attached, and be programmed to control motor 64 to rotate a selected one of coupon rolls 60 in accordance with the information signal received by the controller. As shown in FIG. 8, controller 80 receives a variety of information signals as inputs. These information signals can include, but are not limited to, the type of fluid or fuel being pumped through the filler gun, the product being advertised by the display portion of the display device, or information matched to an individual consumer, taken from a database, and keyed by the consumer's credit card.

For example, the controller 80 can be connected and programmed to receive a variety of information signals from the fluid pump. When used with a gasoline pump, the controller 80 can receive, for example, a signal relating to the octane of gas being pumped. Controller 80 then instructs rotating device 64 to energize, and closes the appropriate contact 66 or 68, to link motor 64 to the appropriate coupon roll 60, in order to dispense with coupons relating to that octane of gasoline.

Alternatively, controller 80 can be pre-programmed with information related to the product or service being advertised on display placard 50. When the trigger 24 of filler gun 20 is depressed, controller 80 energizes rotating device 64, and closes the appropriate contact 66 or 68 to rotate the appropriate coupon roll 60, in order to dispense a coupon related to the advertised product or service.

Many service station pumps now are operated by inserting a credit card into a card reader slot provided on the pump. A signal identifying the credit card owner can be supplied to a computer database, where marketing information related to that particular consumer is stored. The marketing information can be input to controller 80, which in turn energizes rotating device 64 and closes the appropriate contact 66 or 68 to rotate the appropriate coupon roll 60, in order to dispense a coupon selected for that particular consumer.

It is further preferred that a time delay mechanism be provided to delay operation of the rotating device for a preselected amount of time following a previous operation of the rotating device. As shown in FIG. 8, a time delay device 81, for example an electric switch, is inserted between controller 80 and rotating device 64. Alternatively, for example in an embodiment where controller 80 is not included, time delay device 81 can be provided as an integral part of rotating device 64. Time delay device 81 functions to prevent rotating device 64 from operating for a preselected time following a previous operation.

The purpose of the time-delay feature is to prevent a single operator from operating the filler gun in continuous sequence, and removing more than one coupon from the coupon dispenser. For example, it has been determined that there is typically a minimum of a three minute time delay between each separate user's operation of a gas pump filler gun. Accordingly, time delay device 81, e.g., a switch, can be programmed to open and remain open for three minutes after the previous coupons have been fed, thereby preventing reenergization of the rotating device 64 for three minutes and discouraging one customer from attempting to take a second coupon.

In the above described embodiments, carrying body 32 releasably attaches to filler gun 20. The invention is not limited only to detachable display devices, however. It is within the scope of the invention to provide the coupon dispenser with a display device that is an integral part of the gun head itself.

Figure 9:
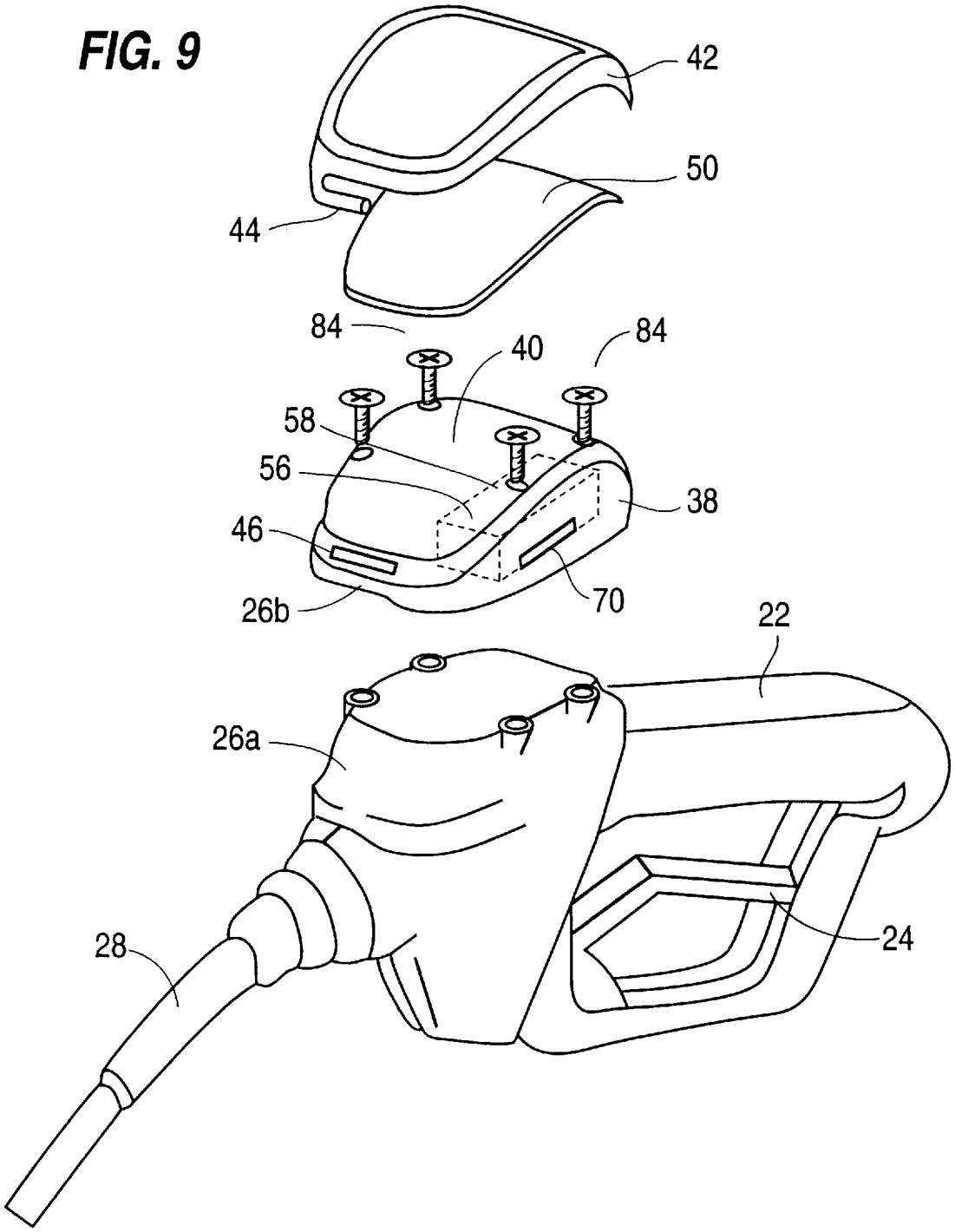
FIG. 9 is a perspective exploded part view of a sixth embodiment of the invention.

As shown in FIG. 9, gun head 26 includes a lower portion 26*a*, comprising the side portions, and an upper portion 26*b*, corresponding to an upper portion 38 of the detachable carrying body of the previous embodiments. In the embodiment of FIG. 9, upper portion 26*b* attaches to lower portion 26*a* with a plurality of threaded fasteners 84, but this is not required. Upper portion 26*b* and lower portion 26*a* can be welded together or molded as an integral unit.

In the embodiment of FIG. 9, the frame 42 pivotally attaches to upper portion 26*b* of the gun head, holding a replaceable display placard 50 between the frame 42 and display surface 40. A door 56 in upper portion 26*b* of the gun head, covers coupon dispenser housing 58. One or more rolls of coupons 60 and a rotating device 64, although not shown in FIG. 9, are mounted in housing 58, and coupons are fed through slot 70. Preferably, a controller 80 and time delay device 81 are provided to control feed of the coupons as discussed above.

Figure 10:
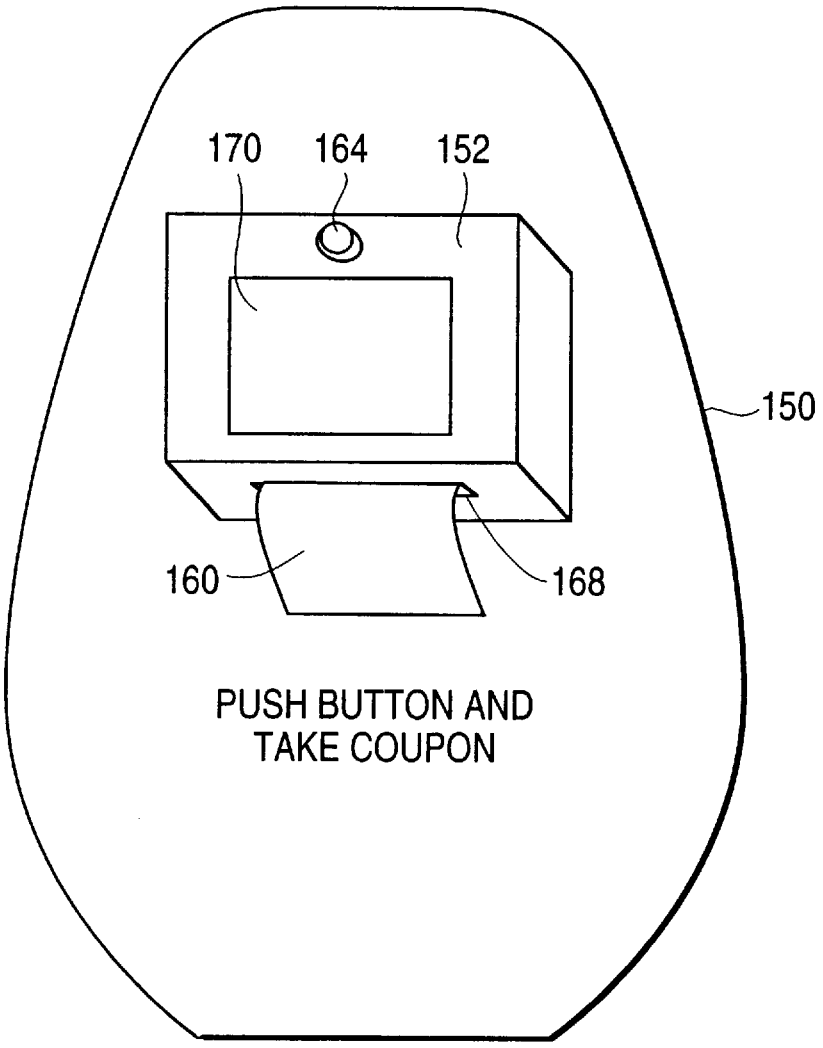
FIG. 10 is a top view of a seventh embodiment of the invention.
Figure 11:
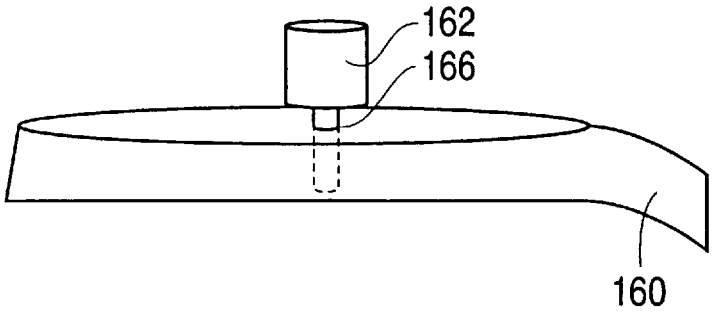
FIG. 11 is a side view of a roll of coupons in a configuration particularly suitable for use with the embodiment of FIG. 10.
Figure 12:
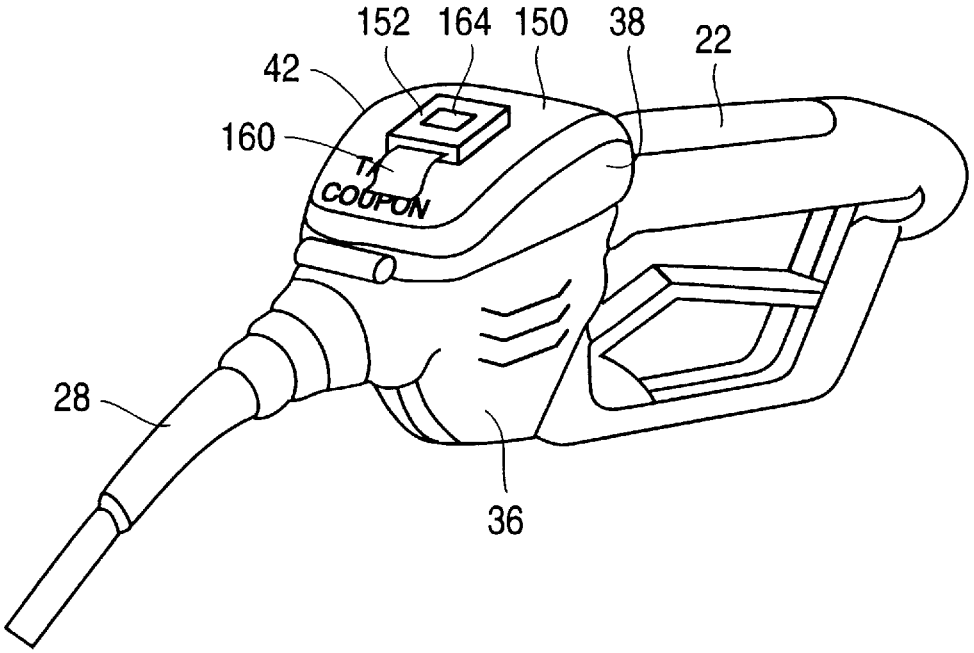
FIG. 12 is a perspective view of fluid filler gun and display device, including the embodiment of FIG. 10.

Another embodiment of the present invention is depicted in FIGS. 10–12. It is contemplated that the use of coupon dispensing feature in combination with a filler gun display device preferably may be performed as part of a temporary advertising campaign. In this case, it would be preferable to use existing fluid filler guns and display devices without modification to the structures thereof. In such cases, a display that includes a coupon dispensing capability could be provided, removably insertable into a display device of a fluid filler gun.

In accordance with the invention, such a display includes a card defining a support surface, configured to removably insert into the filler gun display device. As shown in FIG. 10, a display card 150 is made of a rigid material, such as aluminum or hard plastic, thereby defining a support surface. This display card 150 can be inserted into a display device in place of the standard display card 50, as shown for example in FIG. 12.

In accordance with the invention, a housing is mounted on the support surface, the housing being configured to enclose a removable plurality of coupons. As shown in FIGS. 10 and 12, a housing 152 is attached to display card 150. Housing 152 is preferably compact in order not to make the filler gun unwieldy, but is large enough to enclose a plurality of coupons and a feeding mechanism, as described below.

It is preferred that the coupons be packaged in a compact form, particularly in the display and embodiment of FIG. 10. Accordingly, FIG. 11 depicts a preferred means of packaging a roll of narrow coupons 160, oriented on their side, in order to fit within the confined space allotted to housing 152.

In accordance with the invention, a means is provided for feeding the coupons sequentially through an opening in the housing. As shown in FIG. 11, a spring-loaded ratchet feeding device 162 is provided, which upon activation by a push button 164, shown in FIGS. 10 and 12, or a rotatable stem (not shown), rotates a spindle 166 by a preselected number of rotations necessary to feed one or more coupons 160 through a slot 168 in housing 152. Other types of feeding devices also can be used. For example, it may be preferable to use a stack of coupons 160 in place of a roll. In such an embodiment, the feeding device could include a spring loaded paddle configured to strike the edge of sequential coupons in the stack and feed them through slot 168. Alternatively, the feeding device could include a pair of nip rollers, or other well known paper feeding mechanisms.

It is preferred that housing 152 be provided with a viewing window 170, as shown in FIG. 10. Viewing window 170 opens to the interior of housing 152, and enables the customer to see when the housing 152 is empty of coupons 160. It is preferred that the bottom surface of housing 152 include a message, such as "Empty-Notify Attendant" or the like.

Additional advantages and modifications will readily occur to persons of ordinary skill in the art. The invention, therefore, is not limited to the specific details or the present preferred embodiments disclosed above. Departures may be made from such details without departing from the scope of the inventor's concept. The scope of the invention is limited only by the attached claims and their equivalents.

What is claimed is:

1. A display device attachable to a fluid filler gun, the filler gun including a barrel, a gun head, and a handle, the display device comprising:

a carrying body removably attachable to the gun head, said carrying body including side portions and an upper portion having an upper surface;

a frame attached to the upper portion of said carrying body, said frame and the upper surface defining a display portion for holding a removable display placard;

a coupon dispenser housing defined in said carrying body for holding a replaceable roll of coupons; and a means provided in said carrying body for rotating the roll of coupons and feeding the coupons through a coupon dispensing slot defined in one of the side portions or the upper portion of said carrying body.

2. The display device of claim 1, further comprising a controller for controlling operation of the rotating means in response to operation of the filler gun.

3. The display device of claim 1, wherein said rotating means is controlled to feed out one or more coupons in response to each use of the filler gun.

4. The display device of claim 1, wherein said coupon dispenser housing includes a spindle mounted in said housing and linked to said rotating means, for holding the roll of coupons.

5. The display device of claim 1, wherein said coupon dispenser housing is configured to hold a plurality of replaceable rolls of coupons.

6. The display device of claim 5, wherein said rotating means is linked separately to each of the plurality of rolls of coupons.

7. The display device of claim 6, further comprising a controller for controlling operation of the rotating means to rotate a selected roll of coupons in response to an information signal provided to said controller.

8. The display device of claim 1, wherein the side portions and upper portion of said carrying body define a sleeve having two open ends, said carrying body being slidable onto the gun head, with the barrel projecting through one open end, and the handle projecting through the other open end.

9. The display device of claim 1, wherein said carrying body is made of rigid plastic.

10. The display device of claim 1, wherein said frame is removable from the upper portion of said carrying body.

11. The display device of claim 1, wherein said frame is pivotably attached to the upper portion of said carrying body.

12. The display device of claim 1, wherein said frame is disposed over a first portion of the upper surface of the upper portion of said carrying body, and the coupon dispensing slot is provided in a second portion of the upper surface of the upper portion of said carrying body.

13. The display device of claim 1, wherein the side portions and upper portion of said carrying body comprise a molded unitary body.

14. The display device of claim 1, wherein the upper portion of said carrying body is removable from the side portions of said carrying body.

15. The display device of claim 1, wherein said rotating means includes a motor.

16. The display device of claim 1, wherein said rotating means includes a spring-loaded rotating mechanism.

17. The display device of claim 1, further comprising a time delay device to delay operation of said rotating means for a preselected time period following a previous operation of said rotating means.

18. A fluid filler gun, comprising:

a barrel, a gun head, and a handle, said handle including a trigger for operating a valve housed in said gun head to route fluid through said gun head and said barrel, said gun head including side walls and an upper surface;

a frame attached to the upper surface of said gun head, said frame and the upper surface defining a display portion for holding a removable display placard;

a coupon dispenser housing defined in said gun head for holding a replaceable roll of coupons; and a means provided in said gun head for rotating the roll of coupons and feeding the coupons through a coupon dispensing slot defined in one of the side walls or the upper surface of said gun head.

19. The fluid filler gun of claim 18, wherein said rotating means is configured to operate in response to operation of the trigger.

20. The fluid filler gun of claim 18, further comprising a controller for controlling operation of the rotating means, in response to an external information signal.

21. The fluid filler gun of claim 20, wherein said coupon dispenser housing is configured to hold a plurality of replaceable rolls of coupons, each roll linked separately to said rotating means.

22. The fluid filler gun of claim 21, wherein said controller controls operation of the rotating means to rotate a selected roll of coupons in response to an information signal provided to said controller.

23. The fluid filler gun of claim 18, wherein said frame is disposed over a first portion of the upper surface of said gun head, and the coupon dispensing slot is provided in a second portion of the upper surface of said gun head.

24. The fluid filler gun of claim 18, wherein said rotating means includes a motor.

25. The fluid filler gun of claim 18, wherein said rotating means include a spring-loaded rotating mechanism.

26. The fluid filler gun of claim 18, further comprising a time delay device to delay operation of said rotating means for a preselected time following a previous operation of said rotating means.

27. A display attachable to a display device of a fluid filler gun, the display comprising:

a card defining a support surface and configured to removably insert into the filler gun display device;

a housing mounted on the support surface, said housing configured to enclose a removable plurality of coupons; and a means for feeding the coupons sequentially through an opening in said housing.

28. The display of claim 27, wherein said housing further includes a viewing window through which the coupons are visible.

29. The display of claim 27, wherein the feeding means includes a spring-loaded feeding mechanism.

* * * * *